US006522220B2

(12) United States Patent
Yamada et al.

(10) Patent No.: US 6,522,220 B2
(45) Date of Patent: Feb. 18, 2003

(54) FREQUENCY VARIABLE FILTER, ANTENNA DUPLEXER, AND COMMUNICATION APPARATUS INCORPORATING THE SAME

(75) Inventors: Yasuo Yamada, Kanazawa; Kikuo Tsunoda, Mishima-gun; Masayuki Atokawa, Kanazawa; Hirofumi Miyamoto, Kanazawa; Hajime Suemasa, Nomi-gun, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/838,815

(22) Filed: Apr. 19, 2001

(65) Prior Publication Data

US 2002/0030556 A1 Mar. 14, 2002

(30) Foreign Application Priority Data

Apr. 19, 2000 (JP) ..... 2000-118689
Dec. 1, 2000 (JP) ..... 2000-367579

(51) Int. Cl.[7] ..... H01P 1/213
(52) U.S. Cl. ..... 333/134; 333/202; 333/207; 333/174

(58) Field of Search ..... 333/134, 202, 333/206, 207, 235, 174

(56) References Cited

U.S. PATENT DOCUMENTS 5,227,748 A * 7/1993 Sroka ..... 333/207
6,085,071 A * 7/2000 Yamada et al. ..... 455/82

* cited by examiner

*Primary Examiner*—Justin P. Bettendorf
*Assistant Examiner*—Dean Takaoka
(74) *Attorney, Agent, or Firm*—Ostrolenk, Faber, Gerb & Soffen, LLP

(57) ABSTRACT

A frequency variable filter in which both the frequency of an attenuation pole and the attenuation bandwidth can be varied. In the frequency variable filter, two serial resonance sections composed of resonators and resonance capacitors are electrically connected to each other via a capacitor. The respective resonator in each of the serial resonance sections is electrically connected in parallel with a corresponding serial circuit composed of a frequency shifting capacitor and a PIN diode. A coupling capacitor electrically connects the junctions defined respectively between the frequency shifting capacitor and the PIN diode in each of the serial circuits.

9 Claims, 5 Drawing Sheets

FREQUENCY VARIABLE FILTER, ANTENNA DUPLEXER, AND COMMUNICATION APPARATUS INCORPORATING THE SAME

BACKGROUND OF THE INVENTION

The present invention relates to frequency variable filters for use in a frequency band such as a microwave band, antenna duplexers, and communication apparatuses incorporating the same.

DESCRIPTION OF THE RELATED ART

In a conventionally known band elimination filter, a variable resonance frequency is provided by connecting a reactance element such as a PIN diode or a variable capacitance diode to a resonator via a capacitor, and performing voltage control of the reactance of the reactance element.

FIG. 9 is an electric circuit diagram showing the structure of a conventional frequency variable band elimination filter 1. The filter 1 is composed of resonators 2 and 3, a coupling capacitor C5, capacitors C1 and C2 for making attenuation poles, frequency shifting capacitors C3 and C4, PIN diodes D1 and D2 as reactance elements, inductors L1 and L2 functioning as choke coils, and control-voltage supplying resistors R1 and R2. In addition, the reference numeral P1 denotes an input terminal electrode, the reference numeral P2 denotes an output terminal electrode, and the reference numeral Vc1 denotes a voltage-control terminal electrode.

Although in the conventional frequency variable band elimination filter 1, the attenuation-pole frequency can be voltage controlled, the attenuation bandwidth cannot be varied. Thus, the conventional filter has limited freedom of design.

SUMMARY OF THE INVENTION

The present invention, however, can provide a frequency variable filter in which both the frequency of an attenuation-pole and the bandwidth of the attenuation are variable. In addition, the present invention can provide an antenna duplexer and a communication apparatus incorporating the frequency variable filter.

In order to accomplish the above objects, according to a first aspect of the present invention, there is provided a frequency variable filter including a plurality of serial resonance sections each formed by resonators and resonance capacitors electrically connected in series, a coupling element electrically connecting the plurality of serial resonance sections, a plurality of serial circuits composed of frequency shifting capacitors and switching elements, each of the serial circuits being electrically connected in parallel with a respective one of the resonators of the serial resonance sections, and a coupling capacitor electrically connecting the junctions between the frequency shifting capacitors and the switching elements. In such a frequency variable filter, the switching elements may be switched on/off so as to vary the frequency of an attenuation pole, and preferably also the attenuation bandwidth. As the switching elements, for example, PIN diodes or field effect transistors may be used. In addition, as the resonators, dielectric coaxial resonators, distributed-constant lines, or the like, may be used.

With the above arrangement, when the switching elements are switched off, the coupling capacitor and the frequency shifting capacitors influence filter characteristics. As a result, the attenuation-pole frequency becomes higher and the attenuation bandwidth is narrowed. In contrast, when the switching elements are switched on, both ends of the coupling capacitor are grounded, whereby only the frequency shifting capacitors influence the filter characteristics. As a result, the attenuation-pole frequency becomes lower and the attenuation bandwidth is broadened.

Furthermore, in the frequency variable filter, the coupling capacitor electrically connecting the junctions defined respectively between the frequency shifting capacitors and the switching elements may be formed by connection electrodes for the frequency shifting capacitors and/or connection electrodes for the switching elements. With this arrangement, the number of capacitor components can be reduced.

In addition, according to a second aspect of the invention, there is provided an antenna duplexer incorporating the above frequency variable filter.

Furthermore, according to a third aspect of the invention, there is provided a communication apparatus incorporating at least one of the above frequency variable filter and the antenna duplexer. In the antenna duplexer and the communication apparatus, the freedom of design can be increased by using the frequency variable filter.

Other features and advantages of the present invention will become apparent from the following description of embodiments of the invention which refers to the accompanying drawings, in which like references denote like elements and parts.

BRIEF DESCRIPTION OF THE DRAWINGS

FIG. 6 is a graph showing frequency characteristics obtained when the PIN diodes of the filter shown in FIG. 1 are switched on;

DETAILED DESCRIPTION OF EMBODIMENTS OF THE INVENTION

A description will be given of a frequency variable filter, an antenna duplexer, and a communication apparatus according to embodiments of the present invention.

First Embodiment: FIGS. 1 to 6

Figure 1:
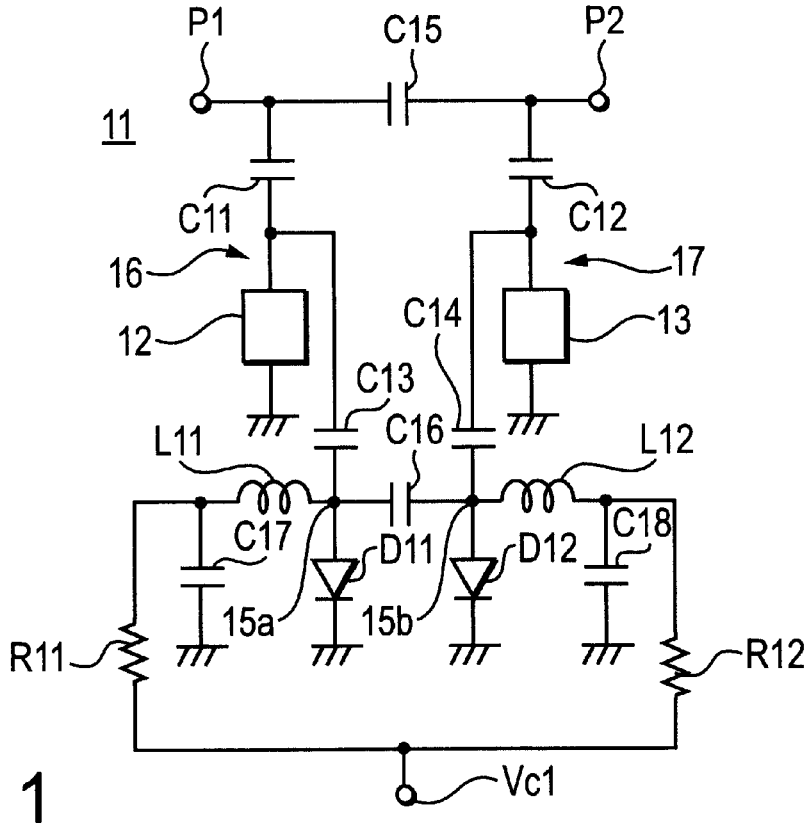
FIG. 1 is an electric circuit diagram of a frequency variable filter according to an embodiment of the present invention.

As shown in FIG. 1, in a frequency variable band elimination filter 11, between an input external terminal P1 and an output external terminal P2, a trap circuit having a serial resonance section 16 composed of a resonator 12 and a resonance capacitor C11 is electrically connected to a trap circuit having a serial resonance section 17 composed of a resonator 13 and a resonance capacitor C12 via a capacitor C15. The resonance capacitors C11 and C12 are capacitors for determining the amount of elimination-band attenuation. Instead of the capacitor C15, a coupling coil or a parallel circuit composed of a coupling coil and a coupling capacitor may be used.

A serial circuit composed of a frequency shifting capacitor C13 and a PIN diode D11 as a voltage-controllable reactance element is electrically connected to the open-circuited-end of the resonator 12 in parallel to the resonator 12 and the cathode of the PIN diode D11 is grounded. Similarly, a serial circuit composed of a frequency shifting capacitor C14 and a PIN diode D12 is electrically connected to the open-circuited-end of the resonator 13. The frequency shifting capacitors C13 and C14 are capacitors for varying two attenuation-pole frequencies of the attenuation characteristics of the filter 11.

Furthermore, a coupling capacitor C16 electrically connects a junction 15*a* between the frequency shifting capacitor C13 and the PIN diode D11 and a junction 15*b* between the frequency shifting capacitor C14 and the PIN diode D12.

A voltage control terminal Vc1 is electrically connected to the anode of the PIN diode D11 via a control voltage supplying resistor R11, a shunt capacitor C17, and a choke coil L11. In addition, the voltage control terminal Vc1 is also electrically connected to the anode of the PIN diode D12 via a control voltage supplying resistor R12, a shunt capacitor C18, and a choke coil L12.

Figure 2:
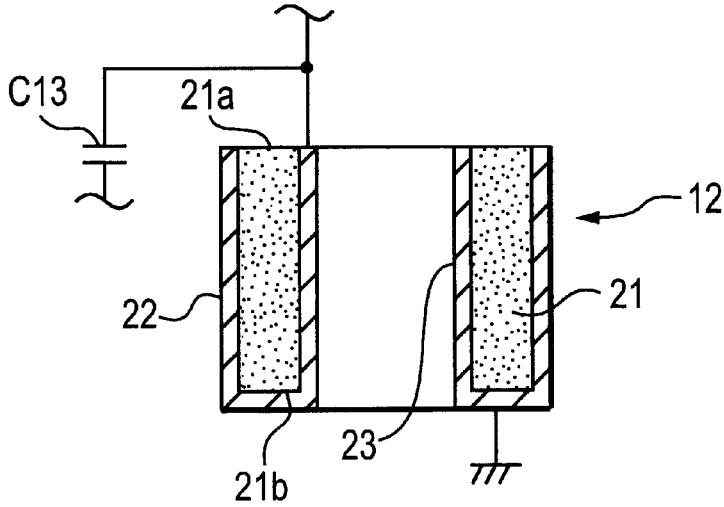
FIG. 2 is a sectional view showing an example of a resonator used in the filter shown in FIG. 1.

As shown in FIG. 2, dielectric coaxial resonators, for example, may be used as the resonators 12 and 13. FIG. 2 shows a resonator 12 as a representative example. Each of the dielectric coaxial resonators 12 and 13 is composed of a tubular dielectric member 21 formed of a high-permittivity material such as a $TiO_2$ ceramic, an outer conductor 22 disposed on the outer peripheral surface of the tubular dielectric member 21, and an inner conductor 23 disposed on the inner peripheral surface thereof. The outer conductor 22 is electrically isolated from the inner conductor 23 at an opening end face 21*a* (hereinafter referred to as an open-circuited end face 21*a*) of the dielectric member 21. The outer conductor 22 is electrically connected (short-circuited) to the inner conductor 23 at the remaining opening end face 21*b* (hereinafter referred to as a short-circuited end face 21*b*). The open-circuited end face 21*a* of the dielectric coaxial resonator 12 is electrically connected to the frequency shifting capacitor C13. At the short-circuited end face 21*b*, the outer conductor 22 is connected to a ground.

Figure 3:
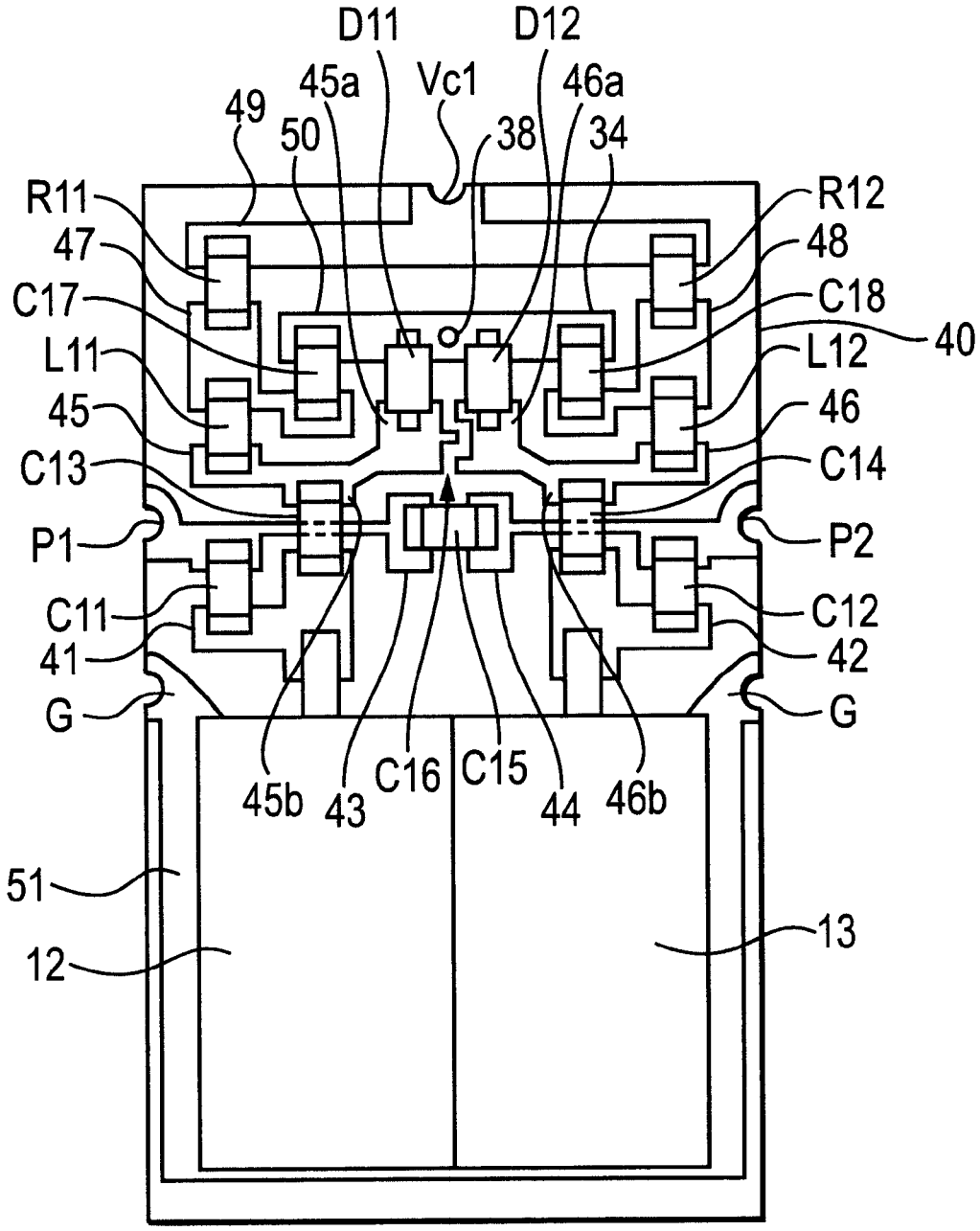
FIG. 3 is a plan view showing an example of the filter shown in FIG. 1.

FIG. 3 is a plan view of the filter 11 in which components are mounted on a circuit board 40. In FIG. 3, the reference numeral 38 denotes a through-hole, the reference numerals 50 and 51 denote ground patterns, and the reference numerals 41 to 49 denote signal circuit patterns. In this case, the signal circuit pattern 45 includes a connection electrode section 45*a* for the PIN diode D11, a connection electrode section 45*b* for the frequency shifting capacitor C13, and a connection electrode section for the choke coil L11. Similarly, the signal circuit pattern 46 includes a connection electrode section 46*a* for the PIN diode D12, a connection electrode section 46*b* for the frequency shifting capacitor C14, and a connection electrode section for the choke coil L12.

The PIN diodes D11 and D12 are arranged close to each other. The anode of the PIN diode D11 is electrically connected to the adjacent connection electrode section 45*a* and the anode of the PIN diode D12 is electrically connected to the adjacent connection electrode section 46*a* by soldering or the like. The coupling capacitor C16 is formed by the connection electrode section 45*a* for the PIN diode D11 and the connection electrode section 46*a* for the PIN diode D12. Mutually facing parts of the connection electrode sections 45*a* and 46*a* are comb-shaped or interdigitated to increase capacitance generated between the connection electrode sections 45*a* and 46*a*. With this arrangement, the number of capacitor components can be reduced by one.

In the first embodiment, the coupling capacitor C16 is formed by the connection electrode section 45*a* for the PIN diode D11 and the connection electrode section 46*a* for the PIN diode D12. However, the coupling capacitor C16 may also be formed by the connection electrode section 45*b* for the frequency shifting capacitor C13 and the connection electrode section 46*b* for the frequency shifting capacitor C14. In this case, the connection electrodes 45*b* and 46*b* will be arranged adjacent to each other and the frequency shifting capacitors C13 and C14 will also be arranged close to each other. Alternatively, a large amount of capacitance may be obtained by forming the coupling capacitor C16 with both the connection electrode sections 45*a* and 45*b* and the connection electrode sections 45*b* and 46*b*.

Next, a description will be given of the operational advantages of the frequency variable band elimination filter 11 having the above structure.

Figure 4A:
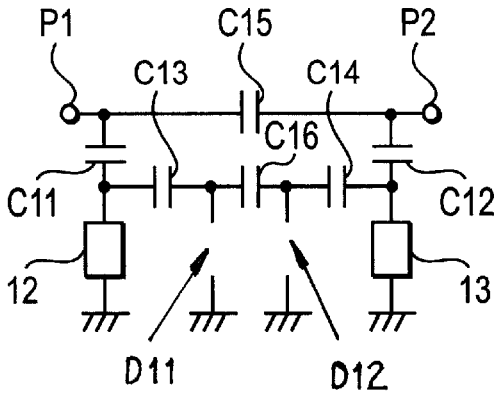
FIGS. 4A and 4B are equivalent circuit diagrams for illustrating the operational principles of the filter shown in FIG. 1 under different respective operating conditions.
Figure 5:
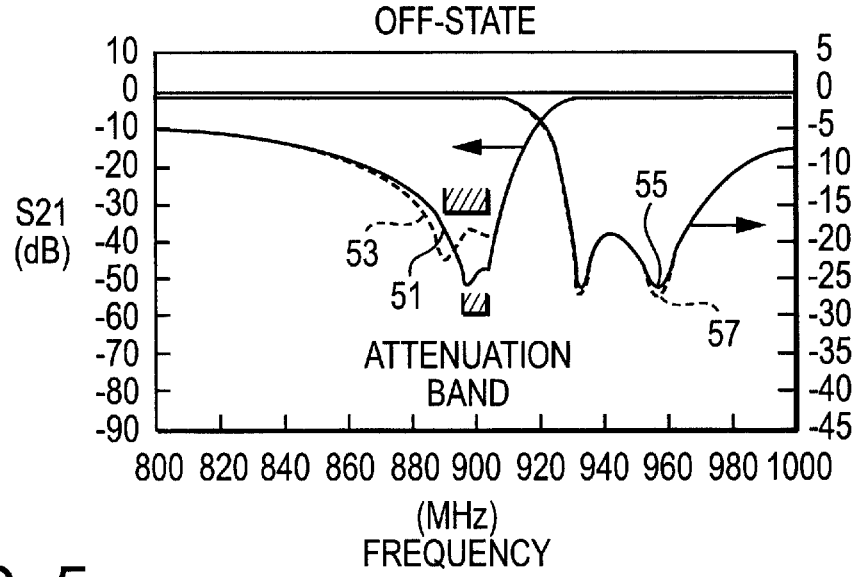
FIG. 5 is a graph showing frequency characteristics obtained when PIN diodes of the filter shown in FIG. 1 are switched off.
Figure 9:
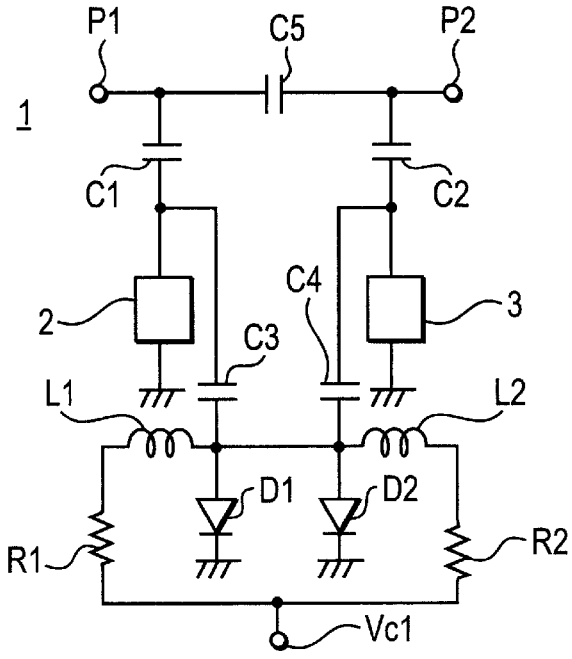
FIG. 9 PRIOR ART
FIG. 9 is an electric circuit diagram of a conventional frequency variable filter.

When a negative voltage or 0V is applied to the voltage control terminal Vc1, the PIN diodes D11 and D12 are switched off. Thus, as shown in FIG. 4A, the resonators 12 and 13 are coupled with each other via the coupling capacitor C16 and the frequency shifting capacitors C13 and C14. With this arrangement, as indicated by a solid line 51 shown in FIG. 5, two attenuation-pole frequencies of the filter 11 both become higher. FIG. 5 is a graph showing transmission characteristics S21 (indicated by the solid line 51) and reflection characteristics S11 (indicated by a solid line 55) of the filter 11 obtained when the PIN diodes D11 and D12 are switched off. For comparison, there are shown transmission characteristics S21 (indicated by a broken line 53) and reflection characteristics S11 (indicated by a broken line 57) of the conventional filter 1 shown in FIG. 9.

Figure 4B:
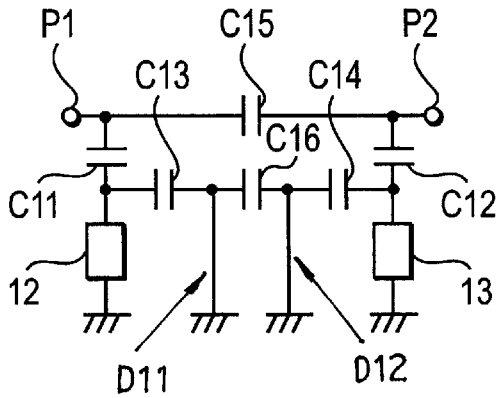
Figure 6:
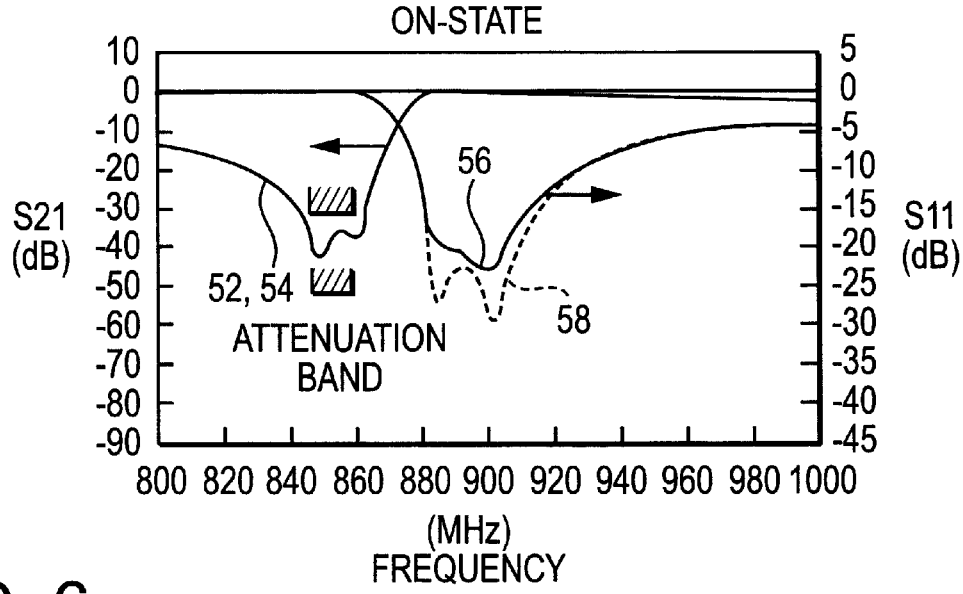

In contrast, when a positive voltage is applied to the voltage control terminal Vc1, the PIN diodes D11 and D12 are switched on, as shown in FIG. 4B, both ends of the coupling capacitor C16 are grounded, and the coupling capacitor C16 thereby does not influence the filter characteristics. With this arrangement, as indicated by a solid line 52 shown in FIG. 6, two attenuation-pole frequencies of the filter 11 both become lower. In this situation, as compared with the case indicated by the solid line 51 shown in FIG. 5, it is found that the two attenuation-pole frequencies shift to the low-frequency side by approximately 50 MHz and, in addition to this, the attenuation bandwidth approximately becomes half. FIG. 6 is a graph showing transmission characteristics S21 (indicated by the solid line 52) and reflection characteristics S11 (indicated by a solid line 56) of the filter 11 obtained when the PIN diodes D11 and D12 are switched on. For comparison, there are shown transmission characteristics S21 (indicated by a broken line 54, which is substantially the same as the solid line 52 and overlaps therewith) and reflection characteristics S11 (indicated by a broken line 58) of the conventional filter 1 shown in FIG. 9.

As shown above, in the frequency variable band elimination filter 11, the transmission band and the attenuation-pole frequency, and also the attenuation bandwidth, can be voltage-controlled.

Figure 7:
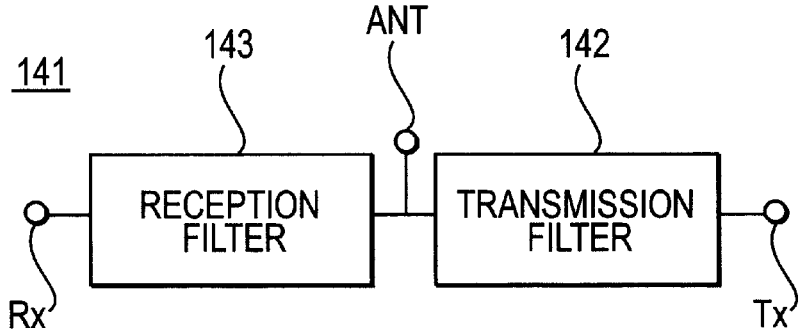
FIG. 7 is an electric circuit block diagram of an antenna duplexer according to an embodiment of the present invention.

Second Embodiment: FIG. 7

As a second embodiment of the invention, there is shown an antenna duplexer. As shown in FIG. 7, in an antenna duplexer 141, a transmission filter 142 is electrically connected between a transmission terminal Tx and an antenna terminal ANT, and a reception filter 143 is electrically connected between a reception terminal Rx and the antenna terminal ANT. In this case, the dielectric filter 11 of the first embodiment can be used as each of the transmission filter 142 and the reception filter 143. By use of the dielectric filter 11, the antenna duplexer 141 has greater freedom of design and can be made compact.

Figure 8:
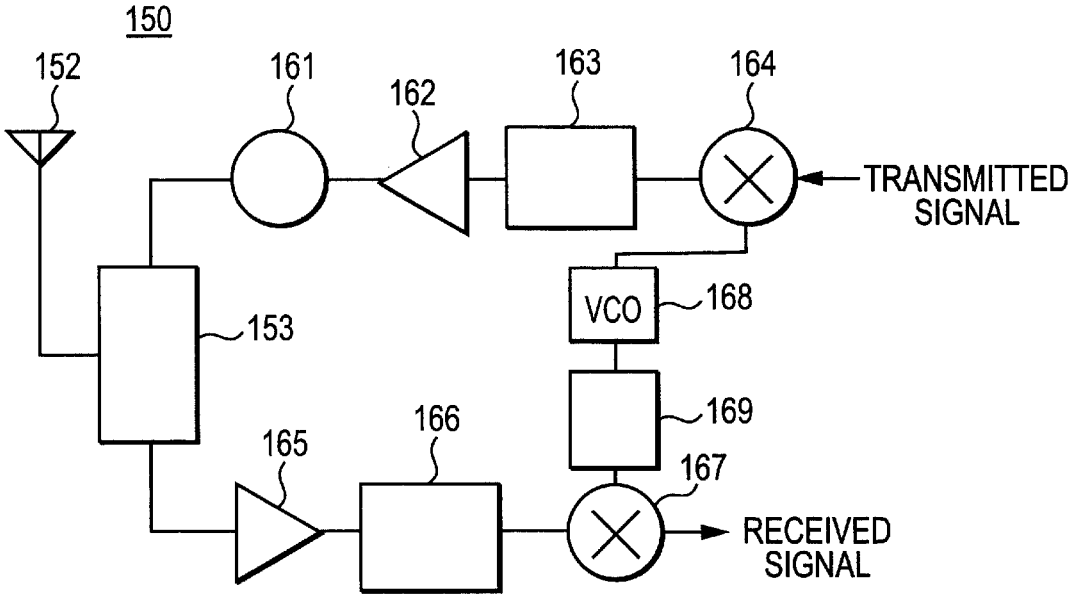
FIG. 8 is an electric circuit block diagram of a communication apparatus according to an embodiment of the present invention.

Third Embodiment: FIG. 8

As a third embodiment of the present invention, there is shown a communication apparatus. A mobile phone will be illustrated as an example for the third embodiment.

FIG. 8 is an electric circuit block diagram of the RF section of a mobile phone 150. In FIG. 8, the reference numeral 152 denotes an antenna element, the reference numeral 153 denotes a duplexer, the reference numeral 161 denotes a transmission-side isolator, the reference numeral 162 denotes a transmission-side amplifier, the reference numeral 163 denotes a transmission-side interstage band pass filter, the reference numeral 164 denotes a transmission-side mixer, the reference numeral 165 denotes a reception-side amplifier, the reference numeral 166 denotes a reception-side interstage band pass filter, the reference numeral 167 denotes a reception-side mixer, the reference numeral 168 denotes a voltage-controlled oscillator (VCO), and the reference numeral 169 denotes a local band pass filter.

In this case, as the duplexer 153, for example, the antenna duplexer 141 of the second embodiment may be used. By using the antenna duplexer 141, the freedom of design of the RF section can be increased and the size of the mobile phone can be reduced.

Other Embodiments

The frequency variable filter, the antenna duplexer, and the communication apparatus according to the present invention are not restricted to the embodiments described above. Various modifications can be made within the scope of the invention. For example, as the switching element, other than a PIN diode, there may be a field effect transistor, a variable capacitance diode, or the like. As the resonators, there may be used distributed-constant lines (strip lines) or the like, rather than a dielectric resonator.

In addition, the structure of each dielectric resonator is not restricted to the structure in each of the above embodiments, in which one inner conductive hole is formed in a single dielectric block; that is, a structure in which a single resonator is formed in a single dielectric block. Alternatively, the dielectric resonator may be provided by forming two or more inner conductive holes in a single dielectric block. That is, two or more resonators or filters may be provided in a single dielectric block.

In addition, the distributed-constant line (strip line) may have a structure in which a strip conductor is separated from a conductive substrate via a dielectric member; a line having a sandwich structure in which a dielectric member is disposed between two conductive substrates and a strip conductor is disposed inside the dielectric member; and the like. In this case, as the above-mentioned dielectric resonator, two or more strip conductors may be disposed in a single block, that is, two or more resonators or filters may be formed inside a single block.

As described above, in the present invention, the coupling capacitor is electrically connected between the two junctions defined respectively between the frequency shifting capacitor and the switching element forming each serial circuit. With this arrangement, the frequency variable filter can be obtained in which both the attenuation-pole frequency and the attenuation bandwidth can be varied. As a result, the antenna duplexer and the communication apparatus having great freedom of design can be obtained.

In addition, the coupling capacitor is formed by the connection electrodes for the frequency shifting capacitors or/and the connection electrodes for the switching elements. With this arrangement, the number of capacitor components can be reduced, thereby leading to miniaturization of the filter.

While the preferred embodiments of the present invention have been described, it is to be understood that modifications will be apparent to those skilled in the art without departing from the spirit of the invention.

What is claimed is:

1. A frequency variable filter comprising:

a plurality of serial resonance sections each formed by a resonator and a resonance capacitor electrically connected in series;

an input terminal and an output terminal connected to respective ones of said plurality of serial resonance sections;

a coupling element electrically connecting the input terminal and the output terminal;

a plurality of serial circuits each composed of a frequency shifting capacitor and a switching element, each of the serial circuits being electrically connected in parallel with a respective one of the resonators of the plurality of serial resonance sections;

wherein switching the switching elements on/off varies both the frequency of an attenuation pole and an attenuation bandwidth of said filter;

junctions defined respectively between the frequency shifting capacitors and the switching elements in each of the serial circuits; and a coupling capacitor electrically connected between said junctions.

2. A frequency variable filter according to claim 1, wherein the switching elements are PIN diodes.

3. A frequency variable filter according to claim 1, wherein the resonators are dielectric coaxial resonators.

4. A frequency variable filter according to claim 1, wherein the coupling capacitor, electrically connected between the respective junctions between the frequency shifting capacitors and the switching elements, is formed by connection electrodes disposed in said filter for mounting the frequency shifting capacitors.

5. A frequency variable filter according to claim 4, wherein the coupling capacitor, electrically connected between the respective junctions between the frequency shifting capacitors and the switching elements, is formed by connection electrodes disposed in said filter for mounting the switching elements.

6. A frequency variable filter according to claim 1, wherein the coupling capacitor, electrically connected between the respective junctions between the frequency shifting capacitors and the switching elements, is formed by connection electrodes disposed in said filter for mounting the switching elements.

7. An antenna duplexer comprising:

a pair of filters, each said filter having first and second terminals;

the respective first terminals of said pair of filters being connected together and to a common input/output terminal;

at least of said filters being the frequency variable filter according to any one of claims 1, 4, 5 and 6.

8. A communication apparatus comprising the antenna duplexer according to claim 7, and further comprising a transmitting circuit connected to the second terminal of one of said filters, and a receiving circuit connected to the second terminal of the other of said filters.

9. A communication apparatus comprising a frequency variable filter according to any one of claims 1, 4, 5 and 6; and further comprising at least one of a transmitting circuit and a receiving circuit connected to said frequency variable filter.

* * * * *